US009181667B2

(12) United States Patent
Kaufman

(10) Patent No.: US 9,181,667 B2
(45) Date of Patent: Nov. 10, 2015

(54) WASTE COLLECTION DEVICE

(71) Applicant: Steven Kaufman, North Weymouth, MA (US)

(72) Inventor: Steven Kaufman, North Weymouth, MA (US)

( * ) Notice: Subject to any disclaimer, the term of this patent is extended or adjusted under 35 U.S.C. 154(b) by 0 days.

(21) Appl. No.: 14/634,541

(22) Filed: Feb. 27, 2015

(65) Prior Publication Data

US 2015/0240434 A1 Aug. 27, 2015

Related U.S. Application Data

(60) Provisional application No. 61/945,565, filed on Feb. 27, 2014.

(51) Int. Cl.
*A01K 29/00* (2006.01)
*E01H 1/12* (2006.01)

(52) U.S. Cl.
CPC ..... *E01H 1/1206* (2013.01)

(58) Field of Classification Search
USPC ..... 294/1.3, 1.4, 1.5, 25, 28, 31.1, 99.2, 294/115, 116, 118; 15/104.8, 571.1, 257.4, 15/257.6, 257.9; 119/161
See application file for complete search history.

(56) References Cited

U.S. PATENT DOCUMENTS

| | | | | |
|---|---|---|---|---|
| 4,428,610 | A * | 1/1984 | Guffey | 294/1.3 |
| 5,620,220 | A * | 4/1997 | Khoshnood | 294/1.3 |
| 5,669,645 | A * | 9/1997 | Chuang | 294/1.3 |
| 5,836,629 | A * | 11/1998 | Hobart | 294/1.3 |
| 6,059,332 | A * | 5/2000 | Beascoechea Inchaurraga | 294/1.3 |
| 6,059,333 | A * | 5/2000 | De Toma | 294/1.3 |
| 7,523,972 | B1 * | 4/2009 | Wawrzynowski | 294/1.3 |
| 8,714,604 | B1 * | 5/2014 | Mihalic | 294/1.4 |
| 2009/0315349 | A1 * | 12/2009 | Black et al. | 294/1.3 |

* cited by examiner

*Primary Examiner* — Paul T Chin
(74) *Attorney, Agent, or Firm* — Druan IP Law

(57) ABSTRACT

A waste collection device operable by movement of one's hand to actuate opposing pivotable jaws around waste material. The jaws each have hinged blades that fold out to slide under the waste material as the jaws are closed. A bag is preferable used in conjunction with the device so that the waste material is captured within the bag as the jaws are closed around it.

12 Claims, 8 Drawing Sheets

FIG. 2
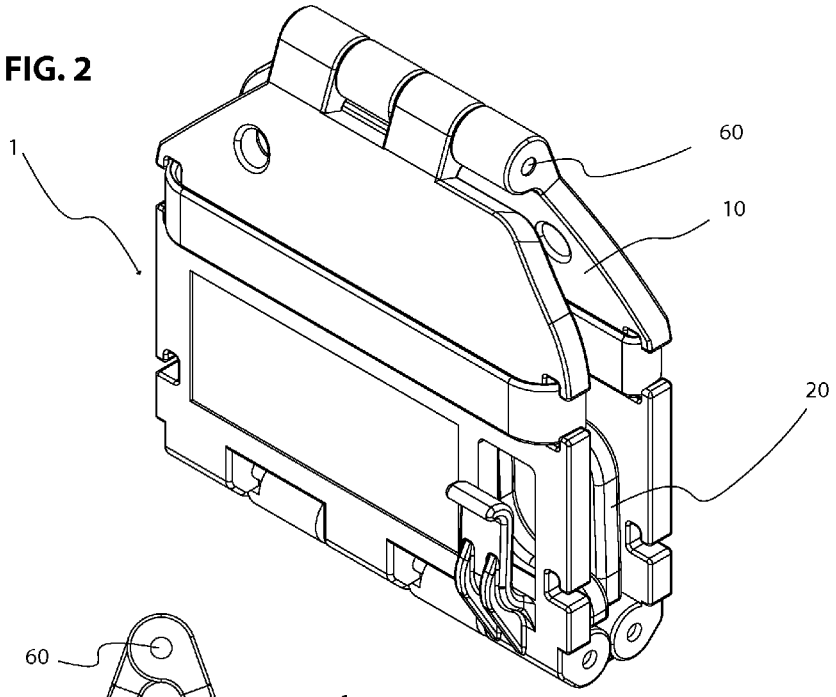
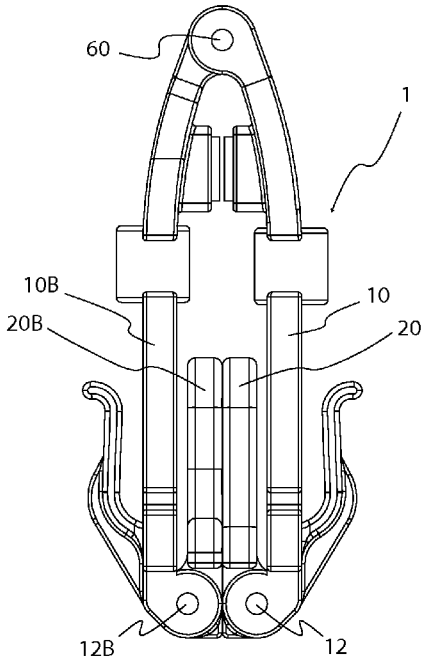
FIG. 3

WASTE COLLECTION DEVICE

RELATED APPLICATIONS

The present U.S. Utility Patent Application claims priority pursuant to 35 U.S.C. §119(e) to U.S. Provisional Application No. 61/945,565 entitled "A versatile, portable, sanitary hand scooper used for picking up animal droppings and unsanitary objects" filed Feb. 27, 2014, hereby incorporated by reference in its entirety and made part of the present U.S. Utility Application for all purposes.

BACKGROUND OF THE INVENTION

This application relates to waste collection devices, and more specifically to hand held devices for sanitarily retrieving solid or semi-solid animal waste and the like from the ground.

Pet owners generally need to clean up after their pets. Typically, a pet owner would use a bag around their hand to retrieve and dispose of animal waste, which creates a highly unpleasant tactile sensation. Various other methods have been devised to avoid this manual retrieval of animal waste, such as the use of scoops, shovels, rakes or other cumbersome tools that are inconvenient to transport, require more than one hand to operate, or not very effective in grassy or sandy environments. Furthermore, use of these tools, including just a bag, usually requires one to carry the device and/or the used bag with them in one hand while holding a leash in the other. In addition to securing animal waste, the removal of other undesirable objects, such as small deceased animals like birds and mice may call for the use of a bag or other device that faces many of the same challenges that animal waste presents. There is therefore a need for a convenient, effective solution for the sanitary retrieval of waste that eliminates the feel of the waste through a bag, can be utilized with one hand, and which can allow for efficient transportation of the device and used waste bag.

BRIEF SUMMARY OF THE INVENTION

The invention relates to a waste collection device that allows for convenient, portable, and sanitary retrieval of animal waste or other undesirable graspable objects from a variety of surfaces. In some embodiments, a waste disposal device is disclosed comprising pivotally connected opposing jaws, each of the jaws having a pivotable blade attached thereon, with a jaw biasing member that acts upon the jaws to maintain the jaws in a closed position.

In other embodiments, a method of removing waste material from a surface is disclosed, including the steps of: grasping a waste collection device that has opposable jaws, each of the jaws having a pivotable blade attached thereon; pivoting the jaws to an open position; inserting a back between the jaws; placing the blades on either side of the waste material; pivoting the jaws toward a closed position; lifting the waste material from the surface; grasping the open end of the bag; and opening the jaws to release the bag and waste material.

The foregoing has outlined rather generally the features and technical advantages of one or more embodiments of this disclosure in order that the following detailed description may be better understood. Additional features and advantages of this disclosure will be described hereinafter, which may form the subject of the claims of this application.

BRIEF DESCRIPTION OF THE DRAWINGS

FIG. 2 shows a top isometric view of the waste collection device of FIG. 1 in a closed configuration;

FIG. 3 shows a side view waste collection device of FIG. 1;

DETAILED DESCRIPTION

Preferred waste collection systems are disclosed herein that address many of the shortcomings of existing devices. The preferred systems comprise a bag combined with a manual waste removal tool that can be used with the bag.

Figure 1:
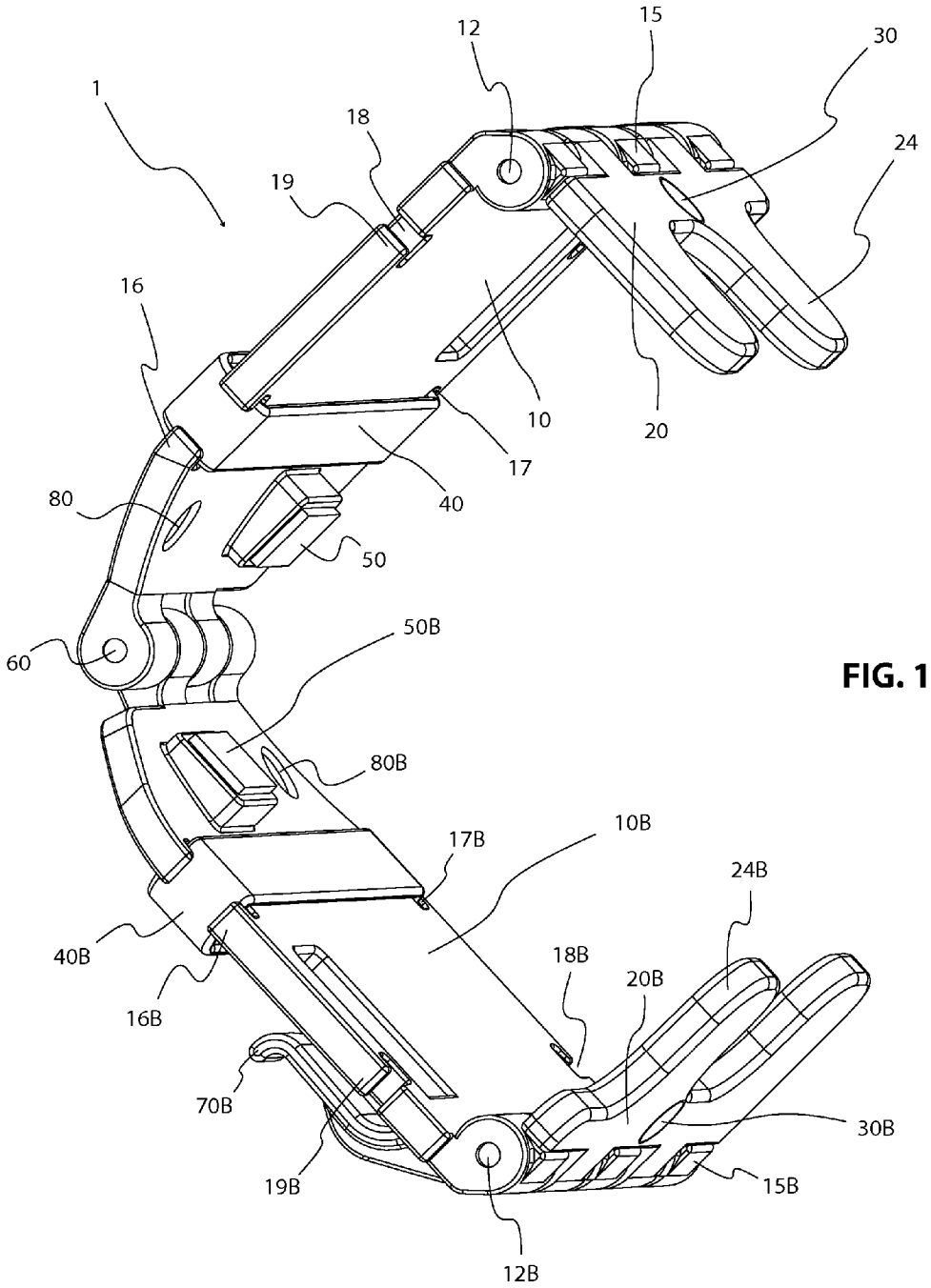
FIG. 1 shows an isometric view of an embodiment of a waste collection device in accordance with the present disclosure in an opened configuration.
Figure 8:
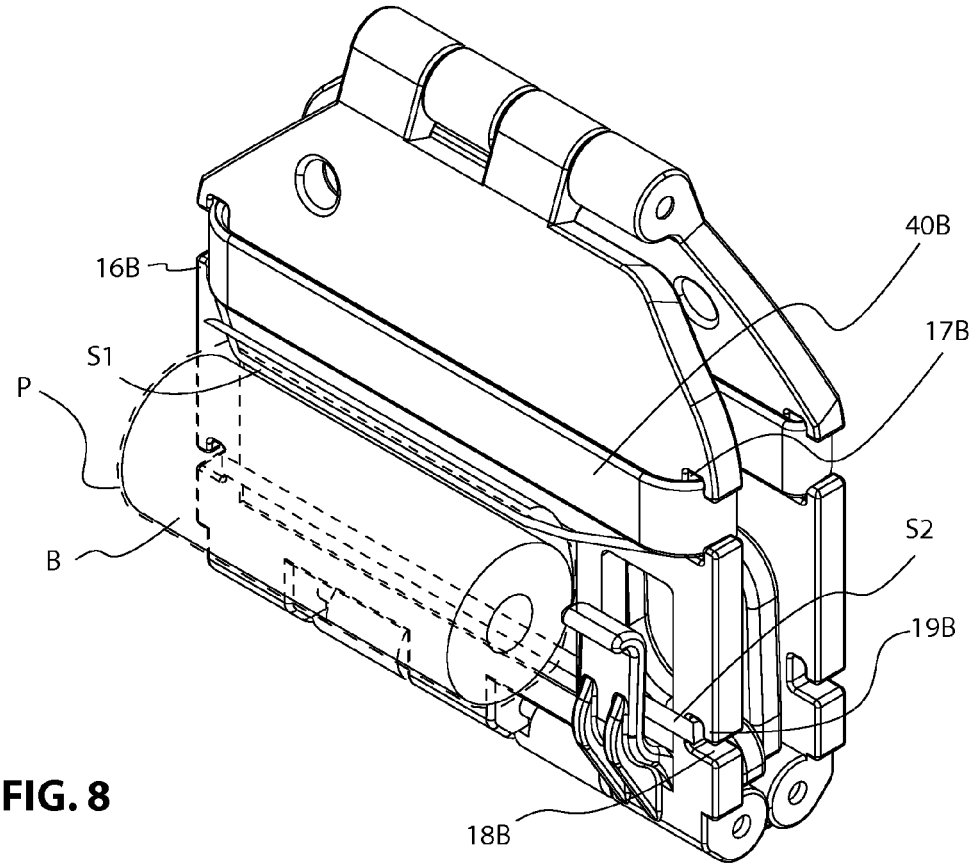
FIG. 8 shows a top isometric view of an embodiment of the waste collection device combined with a bag dispensing accessory.

FIG. 1 shows a preferred embodiment of a waste collection device 1 that comprises opposable jaws 10/10B that are pivotally connected at jaw hinge 60. Each jaw 10/10B is manipulable from a closed position (as seen in FIG. 2) to an open position by means of bands 40/40B. In one exemplary method of opening and closing the device 1, a user inserts their fingers along an outside surface of one jaw 10/10B under a portion of a band 40/40B. The user similarly inserts their thumb along the opposite jaw 10/10B under band 40/40B, whereby opening and closing ones hand will open and close the device 1. The bands 40/40B are secured within a band slot 17/17B on jaws 10/10B by band shoulders 16/16B that extend over the band slots 17/17B. Similarly, each jaw 10/10B has defined therein strap slots 18/18B that are overhung at least partially by strap shoulders 19/19B to secure a strap within the strap slots 18/18B (as seen in FIG. 8). Each jaw also includes a friction block 50/50B on an inside surface thereof. The friction blocks 50/50B cooperate to provide separate surfaces against which a leash or pocket can be secured when the device 1 is in a closed position. Jaws 10/10B also each have a bag hook 70/70B that can secure a used bag thereon, allowing a user to be free from the necessity to carry both the device and a used bag. Jaws 10/10B further include attachment apertures 80/80B for attachment of a lanyard, carabiner, or other attachment device for securing the device 1 to a user, leash, or for general storage.

Each jaw 10/10B also has a blade 20/20B at an end opposite jaw hinge 60. Blades 20/20B are pivotally connected to jaws 10/10B by blade hinges 12/12B form a stowed position (shown in FIG. 2) to an open position. Blades 20/20B are comprised in one embodiment of blade tines 24/24B that are shaped to slide past the blade tines 24/24B of the opposing blade 20/20B when the blades 20/20B are each in the open position and jaws 10/10B are pivoted from an open position towards a closed position. When the blade tines 24/24B are moving past one another, there is, in a preferred embodiment, space between the edges of the tines 24/24B such that sand or blades of grass can pass between the tines 24/2B when the device 1 is closed so that the sand or grass is not substantially removed along with waste material that is being grasped.

Blades 20/20B are prevented from pivoting past an open position by abutting respective blade stops 15/15B. Each blade 20/20B has disposed therein a magnet 30/30B on a bottom surface thereof. When the blades 20/20B are pivoted to their stowed position, a top surface thereof contacts their respective jaw 10/10B. When the jaws 10/10B are closed, the magnets 30/30B attract one another causing the jaws to be pulled into a closed position by the magnetic forces between the magnets 30/30B. This magnetic force maintains the device 1 in a closed position until a user exerts sufficient force to overcome the magnetic attraction that keeps the bottom surfaces of blades 20/20B together. The magnets 30/30B allow the device 1 to be secured to a leash or pocket for hands-free transportation and storage of the device. Magnets 30/30B can also be one or more magnets and corresponding materials that are attracted to magnets, such as a metal surface or other ferromagnetic material.

FIGS. 2 & 3 show the device 1 in a closed position, where each jaw 10/10B has been rotated about jaw hinge 60, and each blade has been rotated about blade hinges 12/12B to their stowed positions, such that the bottom surfaces of blades 20/20B are adjacent, being held together by the magnets 30/30B therein. Alternatively, magnets 30/30B can be replaced in some embodiments by a biasing member, such as a spring, acting upon jaw hinge 60 to urge the jaws 10/10B to a closed position.

Figure 4:
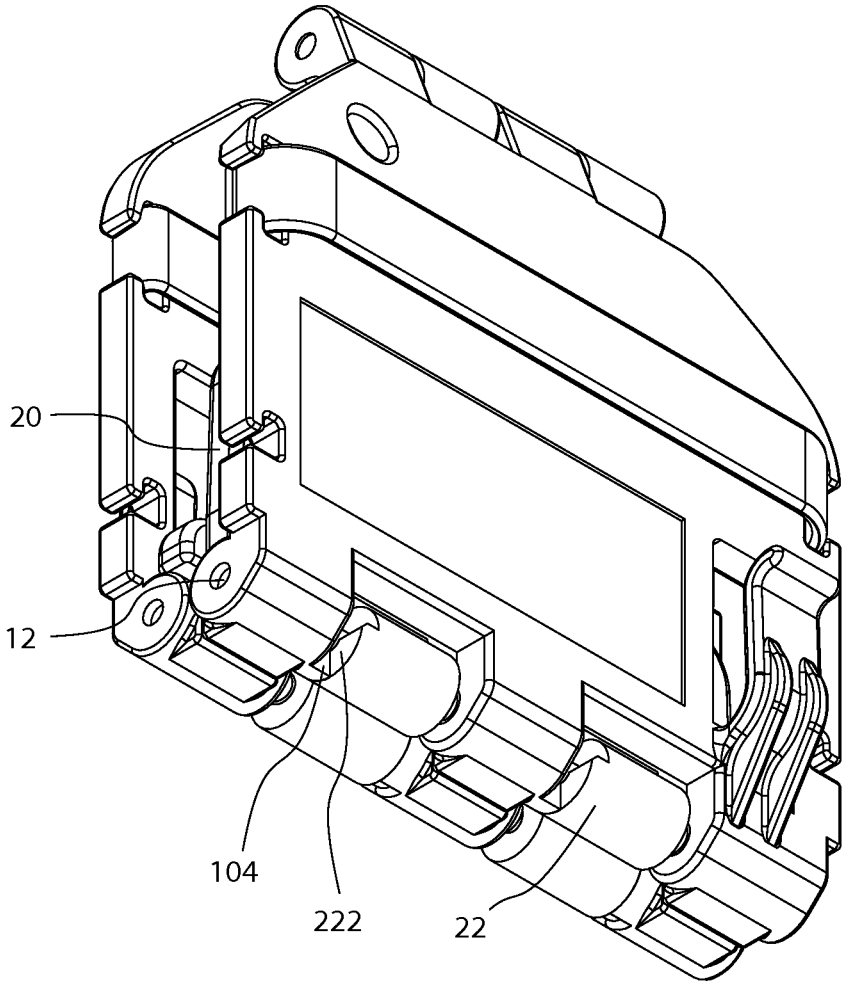
FIG. 4 shows a bottom isometric view of the waste collection device of FIG. 1.
Figure 5:
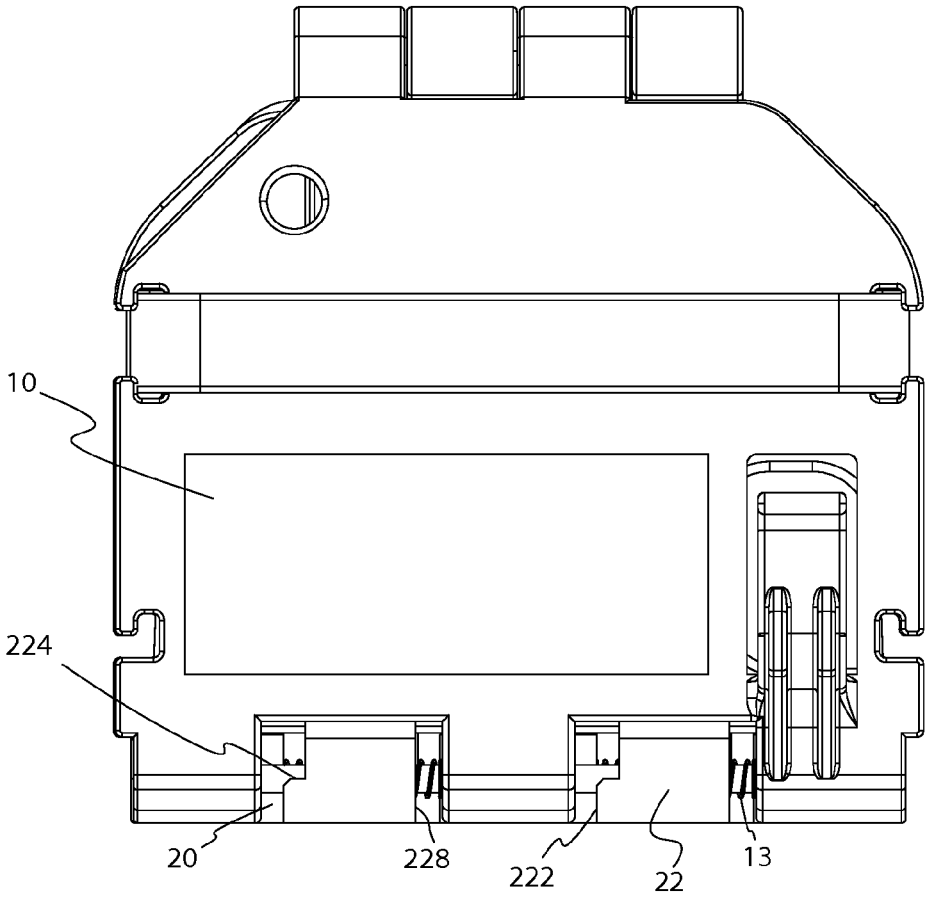
FIG. 5 shows front view of the waste collection device of FIG. 1.
Figure 6A:
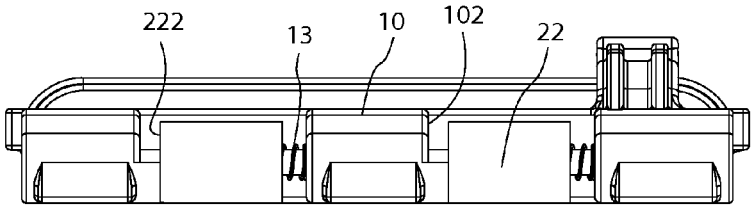
FIGS. 6A-6C show a bottom view of the waste collection device of FIG. 1 as the blades are moved from a stowed position to an open and locked position.
Figure 6B:
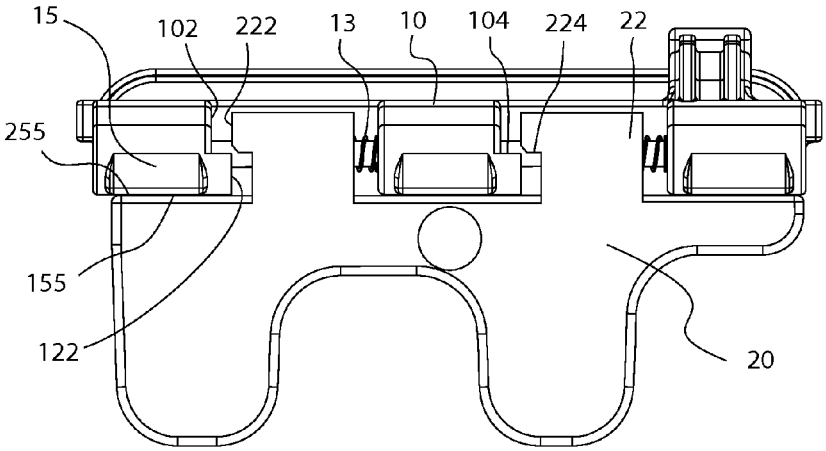
Figure 6C:
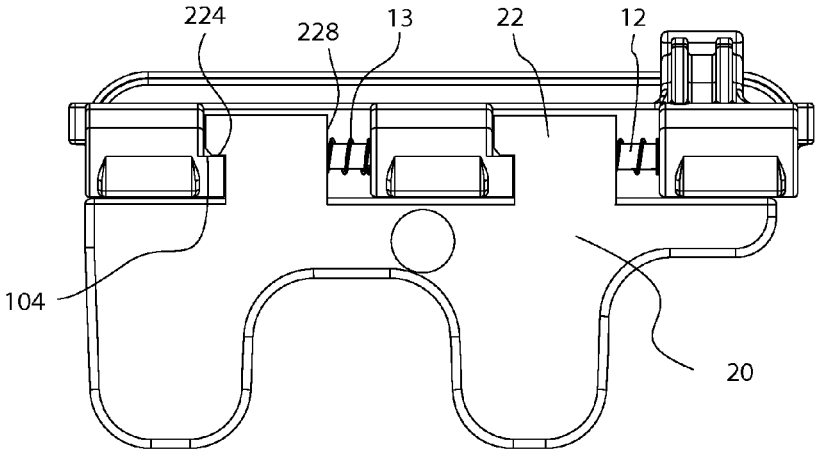

FIGS. 4-6C show an embodiment of the device 1 where blades 20/20B are securable in an open position. While the description here will focus on one jaw 10, it is understood that both jaws 10/10B and blades 20/20B and parts thereof will have analogous structures. In FIG. 4, blade 20 has blade sleeves 22 that rotate about and slide along blade hinge 12. When in the stowed position and while rotating to an open position, blade lock shoulders 222 of blade sleeves 22 slide along jaw sliding surface 122. When the blade 20 reaches an open position (seen in FIGS. 6A-6C), blade lock surface 224 aligns with jaw lock surface 104, and the force applied by spring 13 upon blade spring abutment 228 moves blade 20 along blade hinge 12 until blade lock shoulder 222 abuts jaw lock shoulder 102. In this position, blade inner surface 255 of blade 20 abuts blade stop surface 155 of blade stop 15, preventing the blade 20 from opening past the open position, while the abutment of blade lock surface 224 and jaw lock surface 104 prevent the blade 20 from pivoting towards a stowed position. In order to return the blade 20 to a stowed position, a user must slide the blade 20 along blade hinge 12 against the force of the spring 13 until blade lock shoulder 222 can clear and rotate against jaw sliding surface 122.

Figure 7A:
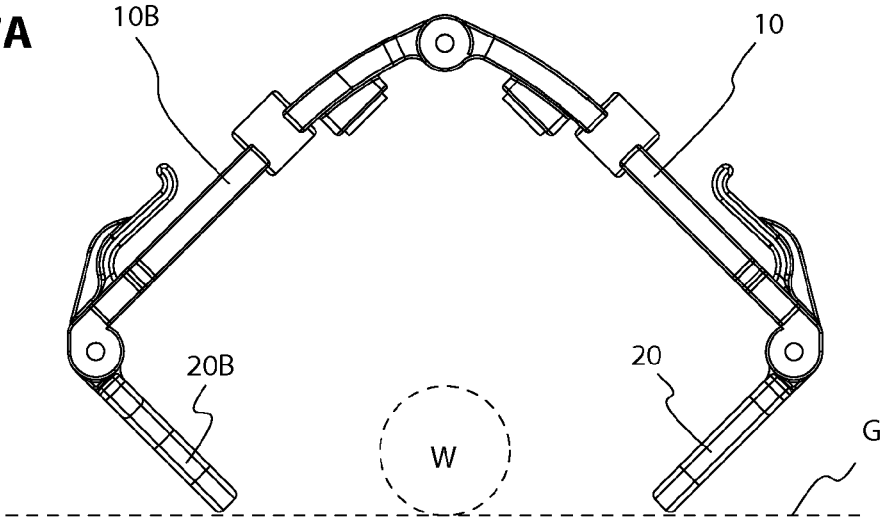
FIGS. 7A & 7B show side views of another embodiment of a waste collection device in an open position as it is being used.
Figure 7B:
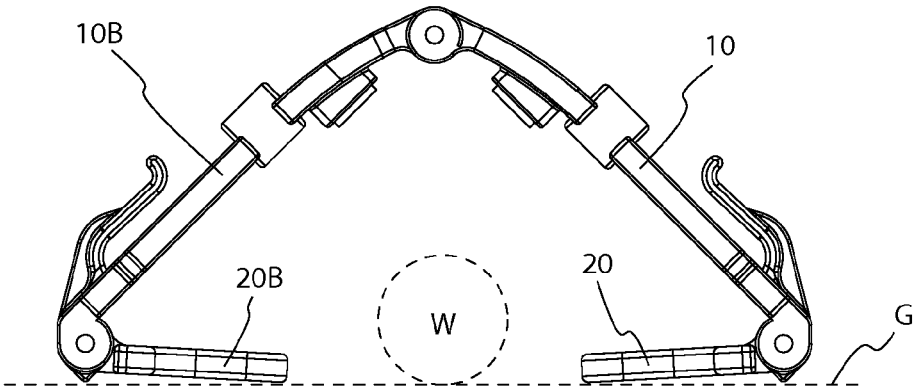

In some embodiments, the blades 20/20B are not locked in an open position, but are instead biased towards an open position by a biasing member acting on the blades 20/20B. In that case, the force acting to keep the the jaws in a closed position (whether that force be by magnets 30/30B or by a biasing member acting about jaw hinge 60) must overcome the force that would attempt to bias the blades 20/20B to their open position. FIGS. 7 & 7A show an embodiment of the device 1 where the blades 20/20B are biased open but unlocked, whereby the blades 20 can rotate when abutting surface G so that the blades 20/20B are substantially parallel to the surface G, and can slide under waste product W when jaws 10/10B are moved towards a closed position.

If the blades 20/20B are biased toward an open position by a biasing member, they will naturally open when jaws 10/10B are opened and the bottom blade surfaces no longer abut one another. If, however, the blades are not biased open, and magnets 30/30B are present within blades 20/20B, then the magnetic force between the magnets 30/30B in blades 20/20B will tend to pull the blades 20/20B to an open position as the jaws 10/10B are opened. If done with sufficient momentum, the blades 20/20B may pivot to a fully open position. If the blade locking mechanisms are utilized as described above, the blades may lock automatically if the momentum drives the blades 20/20B to fully open. In any event, if the blades 20/20B do not fully open due to the magnetic forces of magnets 30/30B and the opening of jaws 10/10B, the user can manually open the blades to their fully open position.

FIG. 8 shows the device 1 in combination with a bag dispenser P holding a plurality of bags B. Bag dispenser P is secured to the device 1 by an upper strap S1 and a lower strap S2. In one example where the bag dispenser P is held onto jaw 10B, upper strap S1 is secured within band slot 17B under band 40B and bound by a band shoulder 16B so that the upper strap S1 remains in band slot 17B. Similarly, lower strap S2 is secured within strap slot 18B and bound by strap shoulder 19B. In some embodiments, straps S1/S2 are preferably made of an elastic material that can be stretched to install and remove the bag dispenser P from the device 1. Each bag B can be a typical bag that includes a closed end or bottom joined by sidewalls that extend from the closed end and terminate at an open end to provide an internal compartment capable of holding waste. The bag can be made of a thin, flexible sheet of plastic or similar material.

Figure 9A:
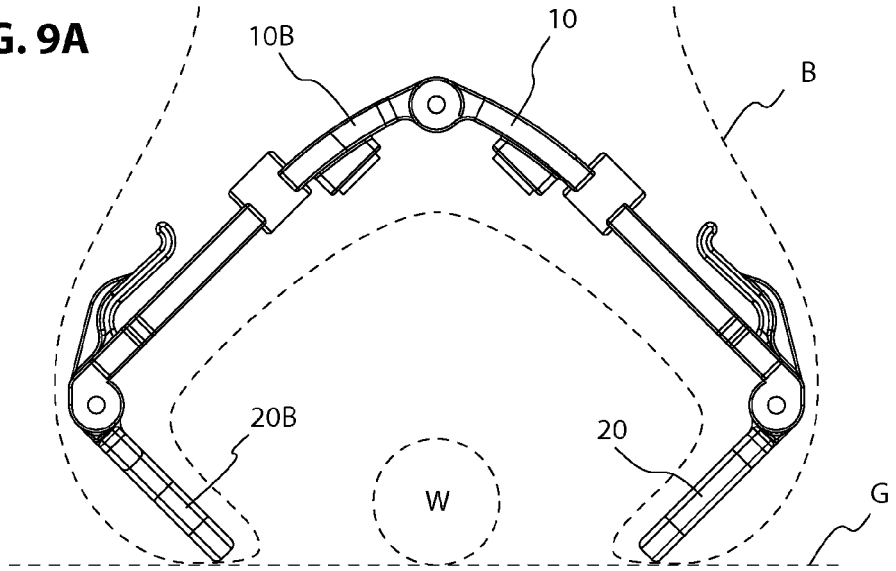
FIGS. 9A & 9B show side views an embodiment of the waste collection device in use with a bag.
Figure 9B:
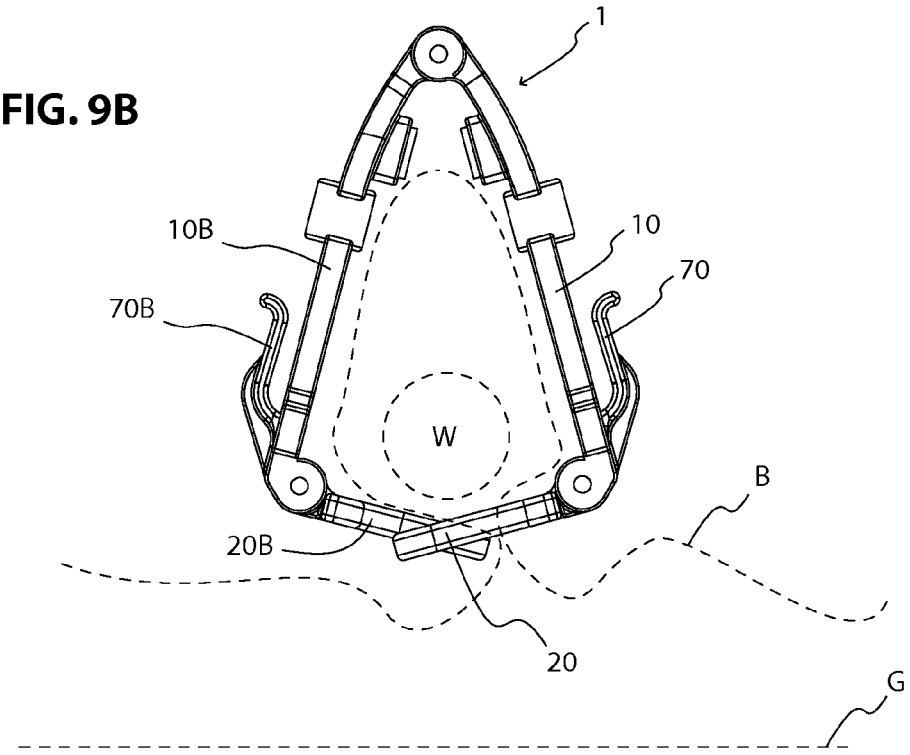

FIGS. 9A & 9B show an example of the device being used with the closed end of bag B inserted between the jaws 10/10B of the device 1, with the open end of the bag B pulled back over the blades 20/20B and jaws 10/10B. When a user closes the device 1 around waste material W on surface G, the blades 20/20B cause bag B to wrap around waste material W and be lifted from surface G. Once lifted, the bag B can be pulled down off jaws 10/10B to capture waste material W within the bag B, which can then be knotted closed and secured to the device 1 by a hook 70/70B. It is important that, for use with bags B, the blade tines 24/24B be smooth such that they do not puncture the bad B, especially as the times move past one another as seen in FIG. 9B.

The device 1 can be made of any suitably rigid material, such as plastic, metal, rubber, wood, or similar. If used, magnets can be any type of rare earth magnet, neodymium magnet, electromagnet, or similar. The general shapes and proportions shown herein are for demonstration purposes only, and do not limit the scope of the invention.

The articles "a" and "an" as used herein in the specification and in the claims, unless clearly indicated to the contrary, should be understood to include the plural referents. Claims or descriptions that include "or" between one or more members of a group are considered satisfied if one, more than one, or all of the group members are present in, employed in, or otherwise relevant to a given product or process unless indicated to the contrary or otherwise evident from the context. The invention includes embodiments in which exactly one member of the group is present in, employed in, or otherwise relevant to a given product or process. The invention also includes embodiments in which more than one or the entire group members are present in, employed in or otherwise relevant to a given product or process. Furthermore, it is to be understood that the invention encompasses all variations, combinations, and permutations in which one or more limitations, elements, clauses, descriptive terms, etc., from one or more of the listed claims is introduced into another claim dependent on the same base claim (or, as relevant, any other claim) unless otherwise indicated or unless it would be evident to one of ordinary skill in the art that a contradiction or inconsistency would arise. Where elements are presented as lists, (e.g., in Markush group or similar format) it is to be understood that each subgroup of the elements is also disclosed, and any element(s) can be removed from the group. It should be understood that, in general, where the invention, or aspects of the invention, is/are referred to as comprising particular elements, features, etc., certain embodiments of the invention or aspects of the invention consist, or consist essentially of, such elements, features, etc. For purposes of simplicity those embodiments have not in every case been specifically set forth in so many words herein. It should also be understood that any embodiment or aspect of the invention can be explicitly excluded from the claims, regardless of whether the specific exclusion is recited in the specification. The entire contents of all of the references (including literature references, issued patents and published patent applications and websites) cited throughout this application are hereby expressly incorporated by reference.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved. Within this specification embodiments have been described in a way which enables a clear and concise specification to be written, but it is intended and will be appreciated that embodiments may be variously combined or separated without parting from the invention. It is intended that the present invention be limited only to the extent required by the appended claims and the applicable rules of law.

I claim:

1. A waste collection device comprising: a first jaw; a second jaw; a jaw hinge pivotally connecting the first and second jaws; a first blade; a first blade hinge pivotally connecting the first blade to the first jaw; a second blade; a second blade hinge pivotally connecting the second blade to the second jaw; and a jaw biasing member; wherein the first and second jaws pivot from a closed position to an open position about the jaw hinge; and wherein the first and second blades pivot from a stowed position to an open position; and wherein the jaw biasing member biases the first and second jaws toward the closed position; wherein the jaw biasing member biases the first and second jaws together when the first and second blades are in their stowed position.

2. The waste collection device of claim 1, wherein the jaw biasing member comprises at least one magnet that is attached to one of the first or second blades, and is magnetically attracted to the other of said first or second blades, whereby when the first and second blades are in a stowed position and the first and second jaws are in the closed position, the magnetic attraction acts to secure the first and second jaws together.

3. The waste collection device of claim 2, wherein each of the first and second blades contain a magnet.

4. The waste collection device of claim 1, further comprising a first band attached to the first jaw between the jaw hinge and the first blade hinge, and a second band attached to the second jaw between the jaw hinge and the second blade hinge, wherein a user can insert their fingers and thumb into the first and second bands such that opening and closing of the users fingers and thumb act to open and close the first and second jaws.

5. The waste collection device of claim 1, wherein the first and second blades are biased toward an open position when the first and second jaws are pivoted from a closed position to an open position.

6. The waste collection device of claim 5, wherein the first and second blades are biased toward an open position by a biasing member acting on the first and second blade hinges.

7. The waste collection device of claim 5, wherein the first and second blades are magnetically attracted to one another, and opening the first and second jaws causes the first and second blades to pull away from their stowed positions and toward their open positions.

8. The waste collection device of claim 1, further comprising a first and second blade locking mechanism that locks the first and second blades, respectively, in their open positions.

9. The waste collection device of claim 8, wherein the first and second blade locking mechanisms each comprise a biasing member, a first locking surface on the respective blade, and a second locking surface adjacent the respective blade hinge, wherein the biasing member continually applies a biasing force along the major axis of the respective blade hinge, and whereby upon reaching the fully open position, the biasing force causes the respective blade to slide along the major axis to engage the first and second locking surfaces, which engagement prevents rotation of the respective blade.

10. The waste collection device of claim 1, wherein the first and second blades each have one or more tines extending therefrom, whereby when the first and second blades are in their open positions and the first and second jaws are pivoted toward their closed position, the tines move past one another into an engaged position such that waste material held between the jaws is fully supported by each of the the at least one tine extending from the blades.

11. The waste collection device of claim 10, wherein, when the tines are in the engaged position, the sides of the tines do not touch, leaving a space for non-waste debris such as sand or grass to pass threrebetween.

12. A method of removing waste material from a surface, comprising the steps of:

grasping a waste removal device that has first and second jaws pivotally attached to one another, first and second blades pivotally attached to the first and second jaws, respectively, and a biasing member that biases the first and second blades from a stowed position toward an open position when the first and second jaws are pivoted from a closed to an open position;

pivoting the first and second jaws from a closed position to an open position, thereby moving the first and second blades toward their open positions;

inserting the closed end of a bag between the first and second jaws;

placing the first and second blades on either side of the waste material such that the waste material is within the confines of the bag;

pivoting the first and second jaws from the open position toward the closed position, thereby closing the bag around the waste material;

lifting the waste material from the surface;

grasping the open end of the bag;

pivoting the first and second jaws toward the open position; and removing the bag and waste material captured therein from the device.

* * * * *